US011447842B2

(12) United States Patent
Chung et al.

(10) Patent No.: US 11,447,842 B2
(45) Date of Patent: Sep. 20, 2022

(54) HIGH-STRENGTH REINFORCING STEEL AND METHOD FOR MANUFACTURING SAME

(71) Applicant: Hyundai Steel Company, Incheon (KR)

(72) Inventors: Jun Ho Chung, Seoul (KR); Won Hoe Kim, Seoul (KR); Jung Wook Park, Incheon (KR); Hyun Sub Kim, Pohang-si (KR)

(73) Assignee: Hyundai Steel Company, Incheon (KR)

( * ) Notice: Subject to any disclaimer, the term of this patent is extended or adjusted under 35 U.S.C. 154(b) by 222 days.

(21) Appl. No.: 16/343,085

(22) PCT Filed: Oct. 20, 2017

(86) PCT No.: PCT/KR2017/011664
§ 371 (c)(1),
(2) Date: Apr. 18, 2019

(87) PCT Pub. No.: WO2018/074887
PCT Pub. Date: Apr. 26, 2018

(65) Prior Publication Data

US 2020/0048726 A1 Feb. 13, 2020

(30) Foreign Application Priority Data

Oct. 21, 2016 (KR) ..... 10-2016-0137271

(51) Int. Cl.
*C22C 38/04* (2006.01)
*C22C 38/42* (2006.01)
(Continued)

(52) U.S. Cl.
CPC ..... *C21D 8/065* (2013.01); *C21D 8/0226* (2013.01); *C22C 38/008* (2013.01); *C22C 38/02* (2013.01);
(Continued)

(58) Field of Classification Search
CPC ..... C21D 8/0226; C21D 2221/10
See application file for complete search history.

(56) References Cited

U.S. PATENT DOCUMENTS

2003/0075250 A1* 4/2003 Ochi ..... C22C 38/06 148/654
2013/0098513 A1* 4/2013 Lee ..... C22C 38/04 148/598
2016/0273067 A1* 9/2016 Monden ..... C22C 38/08

FOREIGN PATENT DOCUMENTS

KR 10-2009-0132796 A 12/2009
KR 20090132796 A * 12/2009
(Continued)

*Primary Examiner* — Anthony J Zimmer
*Assistant Examiner* — Dean Mazzola
(74) *Attorney, Agent, or Firm* — Locke Lord LLP

(57) ABSTRACT

A method for manufacturing a high-strength steel bar can include the steps of: reheating a steel slab at a temperature ranging from 1000° C. to 1100° C., the steel slab including a certain amount of carbon (C), silicon (Si), manganese (Mn), phosphorus (P), sulfur (S), chromium (Cr), copper (Cu), nickel (Ni), molybdenum (Mo), aluminum (Al), vanadium (V), nitrogen (N), antimony (Sb), tin (Sn), and iron (Fe) and other inevitable impurities, The method can further include finish hot-rolling the reheated steel slab at a temperature of 850° C. to 1000° C., and cooling the hot-rolled steel to a martensite transformation start temperature (Ms (° C.)) through a tempcore process.

4 Claims, 5 Drawing Sheets

(51) Int. Cl.

| | |
|---|---|
| ***C22C 38/44*** | (2006.01) |
| ***C22C 38/00*** | (2006.01) |
| ***C22C 38/60*** | (2006.01) |
| ***C22C 38/46*** | (2006.01) |
| ***C22C 38/02*** | (2006.01) |
| ***C22C 38/18*** | (2006.01) |
| ***C22C 38/40*** | (2006.01) |
| ***C21D 8/06*** | (2006.01) |
| ***C21D 8/02*** | (2006.01) |

(52) U.S. Cl.

CPC ..... *C22C 38/04* (2013.01); *C22C 38/18* (2013.01); *C22C 38/40* (2013.01); *C22C 38/42* (2013.01); *C22C 38/44* (2013.01); *C22C 38/46* (2013.01); *C22C 38/60* (2013.01); *C21D 2211/005* (2013.01); *C21D 2211/008* (2013.01); *C21D 2211/009* (2013.01)

(56) References Cited

FOREIGN PATENT DOCUMENTS

| | | | | | |
|---|---|---|---|---|---|
| KR | 10-2011-0066281 | A | | 6/2011 | |
| KR | 10-1095486 | B1 | | 12/2011 | |
| KR | 10-2012-0000766 | A | | 1/2012 | |
| KR | 20120000766 | A | * | 1/2012 | |
| KR | 10-2012-0132829 | A | | 12/2012 | |
| KR | 10-2016-0120235 | A | | 10/2016 | |
| KR | 20160120235 | A | * | 10/2016 | |
| WO | WO-2015076242 | A1 | * | 5/2015 | ..... C22C 38/60 |
| WO | WO-2016199922 | A1 | * | 12/2016 | ..... B32B 15/00 |

* cited by examiner

HIGH-STRENGTH REINFORCING STEEL AND METHOD FOR MANUFACTURING SAME

CROSS-REFERENCE TO RELATED APPLICATIONS

This application is a national phase entry under 35 U.S.C. § 371 of PCT International Application No. PCT/KR2017/011664 filed on Oct. 20, 2017, which claims the benefit of and priority to Korean Patent Application No. 10-2016-0137271 filed on Oct. 21, 2016, the entire contents of each application being incorporated by reference herein.

FIELD

The present invention relates to a high-strength steel bar and a method for manufacturing the same.

BACKGROUND

At present, structural steel is widely applied to skyscrapers, long-span bridges, large marine structures, underground structures, and the like. As these structures in the architectural and civil engineering fields become taller and larger, the lightweight and high strength of structural steel can be an indispensable requirement. Accordingly, even in the case of steel bars which are applied to structures, there is an increasing demand for improving the strength and seismic resistance characteristics of the steel bars.

Prior art documents include Korean Patent No. 10-1095486 (published on Dec. 19, 2011; entitled "Seismic-Resistant Steel Deformed Bar and Seismic-Resistant Steel Deformed Bar Manufactured Thereby").

SUMMARY

An object of the present invention is to provide a method of effectively manufacturing a steel bar having high-strength characteristics through alloy composition control and process control.

Another object of the present invention is to provide a steel bar having high-strength characteristics, manufactured by the above-described method.

A method for manufacturing a high-strength steel bar according to one aspect of the present invention includes the steps of: reheating a steel slab at a temperature ranging from 1000° C. to 1100° C., the steel slab including, by weight %: 0.18% to 0.45% carbon (C); 0.05% to 0.30% silicon (Si); 0.40% to 3.00% manganese (Mn); greater than 0 and not more than 0.04% phosphorus (P); greater than 0 and not more than 0.04% sulfur (S); greater than 0 and not more than 1.0% chromium (Cr); greater than 0 and not more than 0.50% copper (Cu); greater than 0 and not more than 0.25% nickel (Ni); greater than 0 and not more than 0.50% molybdenum (Mo); greater than 0 and not more than 0.040% aluminum (Al); greater than 0 and not more than 0.20% vanadium (V); greater than 0 and not more than 0.040% nitrogen (N); greater than 0 and not more than 0.1% antimony (Sb); greater than 0 and not more than 0.1% tin (Sn); and the balance of iron (Fe) and other inevitable impurities; finish hot-rolling the reheated steel slab at a temperature of 850° C. to 1000° C.; and cooling the hot-rolled steel to a martensite transformation start temperature (Ms (° C.)) through a tempcore process.

In one embodiment, the step of cooling the steel to the martensite transformation start temperature (Ms (° C.)) through the tempcore process may include a step of subjecting the cooled steel to a recuperation process at a temperature of 500° C. to 700° C.

In another embodiment, the steel slab may further include at least one of, by weight %, greater than 0% and not more than 0.50 wt % tungsten (W) and greater than 0% and not more than 0.005% calcium (Ca).

In still another embodiment, the manufactured steel bar may have a composite structure including equiaxed ferrite and pearlite.

A high-strength steel bar according to another aspect of the present invention includes, by weight %: 0.18% to 0.45% carbon (C); 0.05% to 0.30% silicon (Si); 0.40% to 3.00% manganese (Mn); greater than 0 and not more than 0.04% phosphorus (P); greater than 0 and not more than 0.04% sulfur (S); greater than 0 and not more than 1.0% chromium (Cr); greater than 0 and not more than 0.50% copper (Cu); greater than 0 and not more than 0.25% nickel (Ni); greater than 0 and not more than 0.50% molybdenum (Mo); greater than 0 and not more than 0.040% aluminum (Al); greater than 0 and not more than 0.20% vanadium (V); greater than 0 and not more than 0.040% nitrogen (N); greater than 0 and not more than 0.1% antimony (Sb); greater than 0 and not more than 0.1% tin (Sn); and the balance of iron (Fe) and other inevitable impurities, and has a composite structure including equiaxed ferrite and pearlite.

In one embodiment, the high-strength steel bar may further include at least one of, by weight %, greater than 0 and not more than 0.50 wt % tungsten (W) and greater than 0 and not more than 0.005% calcium (Ca).

In another embodiment, the steel bar may have a yield strength of at least 500 MPa and a yield ratio of 0.8 or lower.

Advantageous Effects

In accordance with the present invention, there may be provided a steel bar having high-strength and high seismic resistance characteristics, which has a yield strength of at least 500 MPa and a yield ratio of 0.8 or lower, through alloy composition control and process control.

DETAILED DESCRIPTION

Figure 1:
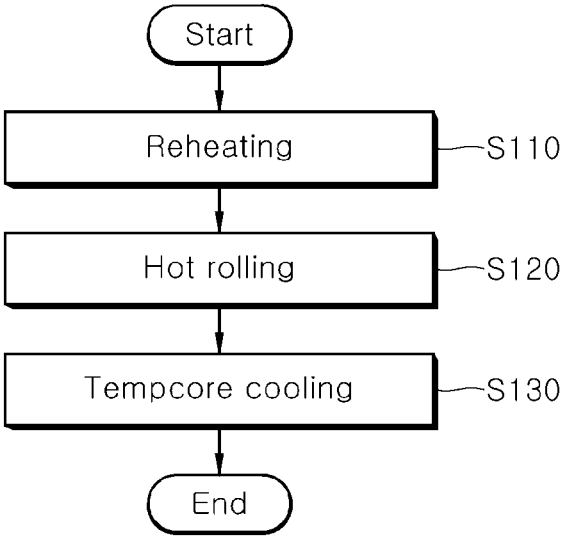
FIG. 1 is a flow diagram schematically illustrating a method for manufacturing a steel bar according to one embodiment of the present invention.

Hereinafter, the present invention will be described in detail with reference to the accompanying drawings so that it can be easily carried out by those skilled in the art. The present invention can be embodied in a variety of different forms and is not limited to the embodiments described in the specification. Throughout the specification, the same reference numerals are used to designate the same or similar elements. In addition, the detailed description of publicly known functions and configurations herein will be omitted when it may unnecessarily obscure the subject matter of the present invention.

Embodiments of the present invention, which will be described below, provide a high-strength steel bar which is manufactured through appropriate component design and process control.

High-Strength Steel Bar

A high-strength steel bar according to an embodiment of the present invention includes, by weight %: 0.18% to 0.45% carbon (C); 0.05% to 0.30% silicon (Si); 0.40% to 3.00% manganese (Mn); greater than 0 and not more than 0.04% phosphorus (P); greater than 0 and not more than 0.04% sulfur (S); greater than 0 and not more than 1.0% chromium (Cr); greater than 0 and not more than 0.50% copper (Cu); greater than 0 and not more than 0.25% nickel (Ni); greater than 0 and not more than 0.50% molybdenum (Mo); greater than 0 and not more than 0.040% aluminum (Al); greater than 0 and not more than 0.20% vanadium (V); greater than 0 and not more than 0.040% nitrogen (N); greater than 0 and not more than 0.1% antimony (Sb); greater than 0 and not more than 0.1% tin (Sn); and the balance of iron (Fe) and other inevitable impurities. In addition, the high-strength steel bar may further include at least one of, by weight %, greater than 0 and not more than 0.50 wt % tungsten (W) and greater than 0 and not more than 0.005% calcium (Ca).

The central portion of the high-strength steel bar may have a composite structure comprising equiaxed ferrite and pearlite, and the surface portion thereof may have a tempered martensite structure.

Specifically, in the cross-section obtained by cutting the high-strength steel bar in the direction perpendicular to the lengthwise direction of the high-strength steel bar, the high-strength steel bar may include ferrite having an area fraction of 24 to 30%, pearlite having an area fraction of 48 to 59%, and tempered martensite having an area fraction of 17 to 22%. The tempered martensite may constitute a hardened layer of the high-strength steel bar. Namely, the hardened layer of the high-strength steel bar may have an area fraction of 17 to 22%.

In one specific example, the grain size of the ferrite may be 8 to 20 μm, and the grain size of the pearlite may be 25 to 48 μm. The central portion of the high-strength steel bar may have a hardness of about 244 Hv, and the hardened layer of the high-strength steel bar may have a hardness of 326 Hv.

The steel bar manufactured by the above-described process may have a yield strength (YS) of at least 500 MPa and a yield ratio (YR) of 0.8 or lower.

Hereinafter, the function and content of each component included in the essential alloy composition of the high-strength steel bar according to the present invention will be described in more detail.

Carbon (C)

Carbon (C) is added to secure the strength of the steel bar. Carbon dissolves in austenite and forms a structure such as martensite in a quenching process, thereby improving the strength of the steel bar. In addition, carbon may bond with elements, such as iron, chromium, molybdenum, and vanadium, to form carbides, thereby improving the strength and hardness of the steel bar.

Carbon (C) is added in an amount of 0.18 to 0.45 wt % based on the total weight of the steel bar. If the content of carbon (C) is less than 0.18 wt %, it may be difficult to secure the strength of the steel bar. On the other hand, if the content of carbon is more than 0.45 wt %, the strength of the steel bar will increase, but a problem may arise in that the cord hardness and weldability of the steel bar decrease.

Silicon (Si)

Silicon (Si) may function as a deoxidizer for removing oxygen from steel in a steelmaking process. In addition, silicon may also function to strengthen solid solution.

Silicon is added in an amount of 0.05 to 0.30 wt % based on the total weight of the steel bar. If the content of silicon is less than 0.05 wt %, it will be difficult to sufficiently secure the above-described effects. If the content of silicon is more than 0.30 wt %, it may form an oxide on the steel surface, thus reducing the weldability of the steel.

Manganese (Mn)

Manganese (Mn) is an element that increases the strength and toughness of steel and increases the hardenability of steel. Manganese is added in an amount of 0.40 to 3.00 wt % based on the total weight of the steel bar. If the content of manganese is less than 0.40 wt %, it may be difficult to secure the strength of the steel bar. On the other hand, if the content of manganese is more than 3.00 wt %, the strength of the steel bar will increase, but the amount of MnS non-metallic inclusions may increase, thus causing defects such as cracks during welding.

Phosphorus (P)

Phosphorus (P) may suppress cementite formation and increase the strength of the steel bar. However, if phosphorus is added in an amount of more than 0.04 wt %, it may reduce the secondary work embrittlement of the steel bar. For this reason, the content of phosphorus (P) is controlled to greater than 0 and not more than 0.04 wt % based on the total weight of the steel bar.

Sulfur

Sulfur (S) may bond with manganese, molybdenum and the like, thus improving the machinability of steel. However, sulfur may form precipitates such as MnS, FeS and the like, and an increase in the amount of such precipitate may cause cracks during hot and cold processing. Hence, the content of sulfur (S) is controlled to greater than 0 and not more than 0.04 wt % based on the total weight of the steel bar.

Chromium (Cr)

Chromium (Cr) may increase the hardenability of steel, thus improving the quenching property.

Chromium is added in an amount of greater than 0 and not more than 1.0 wt % based on the total weight of the steel bar. If chromium is added in an amount of more than 1.0 wt %, it may disadvantageously reduce the weldability or heat-affected-zone toughness of the steel bar.

Copper (Cu)

Copper (Cu) may function to increase the hardenability and low-temperature impact toughness of steel. However, if copper is added in an amount of more than 0.50 wt %, it may cause hot shortness. Hence, the content of copper (Cu) is controlled to greater than 0 and not more than 0.50 wt % based on the total weight of the steel bar.

Nickel (Ni)

Nickel (Ni) may increase the strength of material and ensure low-temperature impact values. However, if the content of nickel is more than 0.25 wt % based on the total weight of the steel bar, it may excessively increase the room-temperature strength of the steel bar, thus reducing the weldability and toughness of the steel bar. Hence, the content of nickel (Ni) is controlled to greater than 0 and not more than 0.25 wt % based on the total weight of the steel bar.

Molybdenum (Mo)

Molybdenum (Mo) improves strength and roughness and contributes to ensuring stable strength at room temperature or high temperature. However, if molybdenum is added in an amount of more than 0.50 wt %, it may reduce the weldability of the steel bar. Hence, molybdenum (Mo) is controlled to greater than 0 and not more 0.50 wt % based on the total weight of the steel bar.

Aluminum (Al)

Aluminum (Al) may function as a deoxidizer. However, if aluminum is added in an amount of more than 0.040 wt %, it may increase the amount of non-metallic inclusions such as aluminum oxide ($Al_2O_3$). Hence, aluminum is controlled to greater than 0 and not more than 0.040 wt % based on the total weight of the steel bar.

Vanadium (V)

Vanadium (V) is an element that acts as pinning at the grain boundary to increase the strength of the steel bar. However, if the content of vanadium (V) is more than 0.20 wt %, a problem will arise in that the production cost of the steel increases. Hence, vanadium is preferably added in an amount of greater than 0 and not more than 0.20 wt % based on the total weight of the steel bar.

Nitrogen (N)

Nitrogen may bond with other alloying elements such as titanium, vanadium, niobium, and aluminum to form nitrides, thus functioning to refine grains. However, if nitrogen is added in a large amount exceeding 0.040 wt %, a problem may arise in that the increased amount of nitrogen reduces the elongation and moldability of the steel bar. Hence, nitrogen is preferably added in an amount of greater than 0 and not more than 0.040 wt % based on the total weight of the steel bar.

Antimony (Sb)

Although antimony (Sb) itself does not form an oxide layer at high temperature, it is enriched on the surface and at the grain boundary, thereby preventing the elements of the steel from diffusing onto the surface, thereby exhibiting the effect of inhibiting oxide formation. In addition, when antimony (Sb) is added in combination with, particularly, Mn and B, it functions to effectively prevent coarsening of a surface oxide layer. However, if the content of antimony (Sb) is more than 0.1 wt %, it will not be economical because it can act as a factor that increases cost only without increasing the effect. Hence, antimony (Sb) is controlled to greater than 0 and not more than 0.1 wt % based on the total weight of the steel bar.

Tin (Sn)

Tin (Sn) may be added to ensure corrosion resistance. However, if tin is added in an amount of more than 0.1 wt %, the elongation of the steel bar may be decreased rapidly. Hence, tin (Sn) is controlled to greater than 0 and not more than 0.1 wt % based on the total weight of the steel bar.

Tungsten (W)

Tungsten (W) is an element which is effective in increasing the room-temperature tensile strength and high-temperature yield strength of steel by improving the hardenability and strengthening solid solution. However, if tungsten is added in an amount of more than 0.50 wt %, the reheating embrittlement of the welding heat-affected zone of the steel bar may be caused by the excessive addition of tungsten. Hence, tungsten (W) is controlled to greater than 0 and not more than 0.50 wt % based on the total weight of the steel bar.

Calcium (Ca)

Calcium (Ca) may be added for the purpose of improving electrical resistance weldability by forming a CaS inclusion and preventing the formation of an MnS inclusion. Namely, since calcium (Ca) has a higher affinity for sulfur than manganese (Mn), the addition of calcium forms a CaS inclusion and reduces the formation of a MnS inclusion. This MnS can be drawn during hot rolling and induce hook defects and the like during electrical resistance welding (ERW), thereby improving electrical resistance weldability.

However, if calcium (Ca) is added in an amount of more than 0.005 wt %, a problem may arise in that the CaO inclusion is excessively formed, thus reducing continuous castability and electrical resistance weldability. Hence, calcium (Ca) is controlled to greater than 0 and not more than 0.005 wt % based on the total weight of the steel bar.

In addition to the above-described components of the alloy composition, the remainder consists of iron (Fe) and impurities which are inevitably incorporated in a steelmaking process and the like.

Method for Manufacturing High-Strength Steel Bar

Hereinafter, a method for manufacturing a steel bar according to one embodiment of the present invention will be described.

FIG. 1 is a flow diagram schematically illustrating a method for manufacturing a steel bar according to one embodiment of the present invention. Referring to FIG. 1, the method for manufacturing the steel bar includes a steel slab reheating step (S110), a hot-rolling step (S120), a tempcore cooling step (S130), and a recuperation step (S140) (not shown). At this time, the reheating step (S110) may be performed to obtain effects such as precipitate re-dissolution. At this time, the steel slab may be obtained by a continuous casting process after obtaining a molten steel having a predetermined composition through a steelmaking process. The steel slab includes, by weight %: 0.18% to 0.45% carbon (C); 0.05% to 0.30% silicon (Si); 0.40% to 3.00% manganese (Mn); greater than 0 and not more than 0.04% phosphorus (P); greater than 0 and not more than 0.04% sulfur (S); greater than 0 and not more than 1.0% chromium (Cr); greater than 0 and not more than 0.50% copper (Cu); greater than 0 and not more than 0.25% nickel (Ni); greater than 0 and not more than 0.50% molybdenum (Mo); greater than 0 and not more than 0.040% aluminum (Al); greater than 0 and not more than 0.20% vanadium (V); greater than 0 and not more than 0.040% nitrogen (N); greater than 0 and not more than 0.1% antimony (Sb); greater than 0 and not more than 0.1% tin (Sn); and the balance of iron (Fe) and other inevitable impurities. In addition, the steel slab may further include at least one of, by weight %, greater than 0 and not more than 0.50 wt % tungsten (W) and greater than 0 and not more than 0.005% calcium (Ca).

Reheating Step

In the step of reheating the steel slab, the steel slab having the above-described composition is reheated at a temperature ranging from 1000° C. to 1100° C. Through this reheating, the re-dissolution of components segregated during casting and the re-dissolution of precipitates may occur. At this time, the steel slab may be a bloom or billet which produced by a continuous casting process which is performed before the reheating step (S110).

If the reheating temperature of the steel slab is lower than 1000° C., the heating temperature will not be sufficient, and thus the re-dissolution of the segregated components and precipitates will not sufficiently occur. In addition, a problem may arise in that rolling load increases. On the other hand, if the reheating temperature is higher than 1100° C., austenite grains may be coarsened or decarbonization may occur, thus reducing the strength of the steel bar.

Hot Rolling

In the hot-rolling step (S120), the reheated steel slab is finish hot-rolled at a temperature of 850° C. to 1000° C. If the finish rolling temperature is higher than 1000° C., austenite grains will be coarsened, and thus ferrite grain refinement after transformation will not sufficiently occur, thus making it difficult to secure the strength of the steel bar. On the other hand, if the finish rolling temperature is lower than 850° C., a rolling load may occur, thus reducing the productivity and the heat-treatment effect.

Specifically, through hot rolling at the above-described temperature, a fine austenite structure and massive ferrite may be formed. Furthermore, during the hot rolling, sub-grains may be formed in the massive ferrite by the continuous dynamic recrystallization of ferrite, and the sub-grains may rotate to form fine ferrite having a high-angle grain boundary. The fine ferrite may subsequently increase the driving force of pearlite transformation.

Tempcore Cooling

In the tempcore cooling step (S130), the hot-rolled steel is cooled to the martensite transformation start temperature (Ms temperature) through a tempcore process in order to ensure sufficient strength. The steel cooled during the tempcore process may be subjected to a recuperation process at a temperature of 500° C. to 700° C.

In one embodiment, the pressure of cooling water in the tempcore process may be 5 to 10 bar, and the flow rate of cooling water may be 450 to 1100 $m^3$/hr.

Through the above-described process, a high-strength steel bar whose central portion has a composite structure including equiaxed ferrite and pearlite and whose surface portion has a tempered martensite structure may be produced.

Specifically, in the cross-section obtained by cutting the high-strength steel bar in a direction perpendicular to the lengthwise direction of the high-strength steel bar, the high-strength steel bar may include ferrite having an area fraction of 24 to 30%, pearlite having an area fraction of 48 to 59%, and tempered martensite having an area fraction of 17 to 22%. The tempered martensite may constitute the hardened layer of the high-strength steel bar. Namely, the hardened layer of the high-strength steel bar may have an area fraction of about 17 to 22%.

In one specific example, the grain size of the ferrite may be 8 to 20 μm, and the grain size of the pearlite may be 25 to 48 μm. The central portion of the high-strength steel bar may have a hardness of about 244 Hv, and the hardened layer of the high-strength steel bar may have a hardness of 326 Hv.

The steel bar manufactured by the above-described process may have a yield strength (YS) of at least 500 MPa and a yield ratio (YR) of 0.8 or less.

Examples

Hereinafter, the constitution and operations of the present invention will be described in more detail with reference to preferred examples of the present invention. However, these examples are provided as preferred examples of the present invention and are not to be construed as limiting the scope of the present invention in any way.

Contents that are not disclosed herein can be sufficiently understood by any person skilled in the art, and thus the description thereof is omitted.

1. Preparation of Specimens

Steel slabs, each including the alloy composition shown in Table 1 and the balance of iron (Fe) and inevitable impurities, were prepared. The steel slabs were hot-rolled under the conditions shown in Table 2 below, thereby preparing a plurality of specimens under the conditions of Examples 1 to 3 and a Comparative Example.

TABLE 1

| | Chemical components (wt %) | | | | | | | | | | | | | |
|---|---|---|---|---|---|---|---|---|---|---|---|---|---|---|
| | C | Si | Mn | P | S | Al | Cr | Ni | Cu | Mo | V | Sn | Sb | N |
| Comparative Example 1 | 0.31 | 0.20 | 1.20 | 0.030 | 0.030 | 0.20 | 0.20 | 0.01 | 0.25 | — | — | — | — | 0.0080 |
| Example 1 | 0.34 | 0.19 | 1.38 | 0.028 | 0.030 | 0.018 | 0.23 | 0.1 | 0.21 | 0.11 | 0.009 | 0.011 | 0.05 | 0.0080 |
| Example 2 | 0.33 | 0.19 | 1.41 | 0.030 | 0.031 | 0.019 | 0.23 | 0.09 | 0.28 | 0.12 | 0.030 | 0.010 | 0.06 | 0.0080 |
| Example 3 | 0.33 | 0.19 | 1.41 | 0.030 | 0.030 | 0.019 | 0.23 | 0.09 | 0.28 | 0.12 | 0.052 | 0.009 | 0.06 | 0.0080 |
| Example 4 | 0.33 | 0.19 | 1.41 | 0.030 | 0.032 | 0.019 | 0.23 | 0.09 | 0.28 | 0.12 | 0.055 | 0.008 | 0.05 | 0.0080 |
| Example 5 | 0.34 | 0.20 | 1.37 | 0.027 | 0.031 | 0.018 | 0.25 | 0.11 | 0.26 | 0.10 | 0.150 | 0.009 | 0.06 | 0.0080 |

TABLE 2

| | Rolling conditions | | |
|---|---|---|---|
| Classification | Reheating temperature | Finish rolling temperature | Recuperation temperature |
| Comparative Example 1 | 1050 | 951 | 570 |
| Example 1 | 1050 | 956 | 550 |
| Example 2 | 1050 | 873 | 600 |
| Example 3 | 1050 | 936 | 610 |
| Example 4 | 1050 | 945 | 670 |
| Example 5 | 1050 | 953 | 700 |

2. Evaluation of Physical Properties

Table 3 below shows the results of evaluating the mechanical properties of the plurality of specimens prepared according to the conditions of the Comparative Example and Examples 1 to 5. For evaluation of the physical properties, the yield strength (YS), tensile strength (TS), elongation (EL) and yield ratio (YR) of each specimen were measured and shown.

TABLE 3

| | | | Material properties | | | |
|---|---|---|---|---|---|---|
| Classification | Specimen No. | Standard (diameter, mm) | Yield strength (MPa) | Tensile strength (MPa) | Elongation (%) | Yield ratio |
| Comparative Example | 1 | D22 | 561 | 680 | 13.7 | 0.83 |
| Example 1 | 2 | D10 | 565 | 791 | 15.7 | 0.71 |
| | 3 | D22 | 582 | 755 | 14.1 | 0.77 |
| | 4 | D32 | 572 | 741 | 14.6 | 0.77 |
| Example 2 | 5 | D22 | 633 | 793 | 13.8 | 0.80 |
| Example 3 | 6 | D16 | 669 | 856 | 15.1 | 0.78 |
| | 7 | D22 | 651 | 854 | 14.8 | 0.76 |
| | 8 | D32 | 643 | 849 | 17.8 | 0.76 |
| Example 4 | 9 | D16 | 646 | 832 | 15.3 | 0.78 |
| Example 5 | 10 | D57 | 641 | 822 | 12.7 | 0.78 |

Referring to Table 3 above, the specimens were prepared to have various diameters. However, the conditions of the Comparative Example and Examples 1 to 3 commonly included a specimen having a diameter of 22 mm (D22). Under the condition of Example 5, a specimen having a diameter of 57 mm (D57) was prepared.

When comparing the yield strength, the specimens under the conditions of the Comparative Example and Examples 1 to 5 all satisfied 500 MPa or higher. In particular, the specimens under the conditions of Examples 2 to 5 (specimen Nos. 5 to 10) exhibited a yield strength of 600 MPa or higher. Meanwhile, the specimen under the condition of the Comparative Example (specimen No. 1) had a yield ratio higher than 0.8, whereas the specimens under the conditions of Examples 1 to 5 all satisfied a yield ratio of 0.8 or lower.

FIGS. 2 to 5 are photographs showing the microstructures of the steel bars according to the Comparative Example and the Examples of the present invention. Table 4 below shows the results of observing the microstructures of the plurality of specimens prepared under the conditions of the Comparative Example and Examples 1 to 5. The microstructures were obtained by observing the central portions of the steel bars, and the surface portions of the steel bars, which are compared with the central portions, may include tempered martensite.

TABLE 4

| Classification | Specimen No. | Standard (diameter, mm) | Microstructure: Structure phase of central portion | Microstructure: Grain size (μm) |
|---|---|---|---|---|
| Comparative Example | 1 | D22 | Mixed phase of equiaxed ferrite and pearlite | 95 ± 6.4 |
| Example 1 | 2 | D10 | | 27 ± 3.9 |
| | 3 | D22 | | 42 ± 6.3 |
| | 4 | D32 | | 48 ± 5.2 |
| Example 2 | 5 | D22 | | 36 ± 7.4 |
| Example 3 | 6 | D16 | | 25 ± 7.1 |
| | 7 | D22 | | 28 ± 5.2 |
| | 8 | D32 | | 32 ± 8.7 |
| Example 4 | 9 | D16 | | 44 ± 9.3 |
| Example 5 | 10 | D57 | | 41 ± 13.2 |

Figure 2:
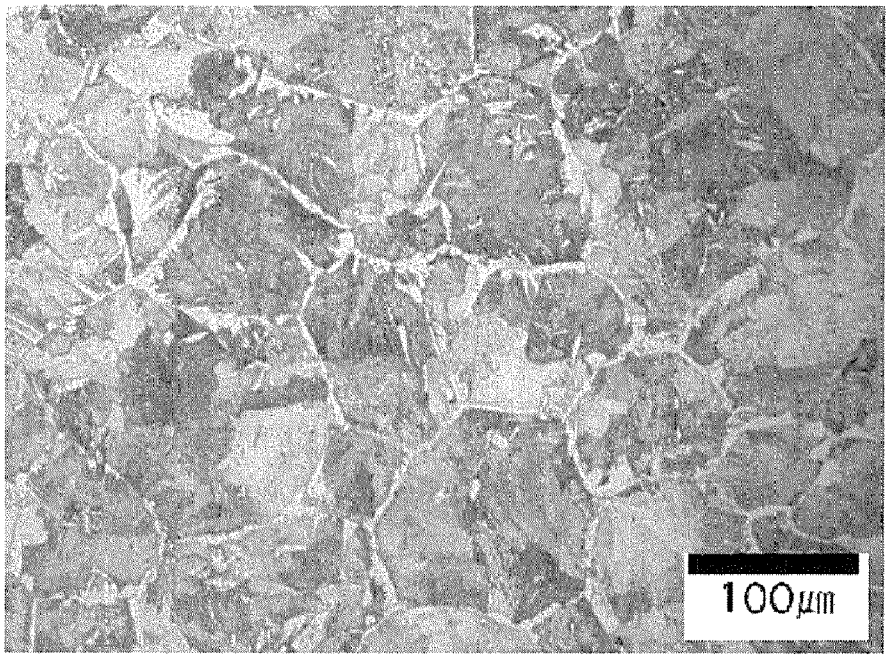
FIGS. 2 to 5 are photographs showing the microstructures of steel bars according to the Comparative Example and Examples of the present invention.
Figure 3:
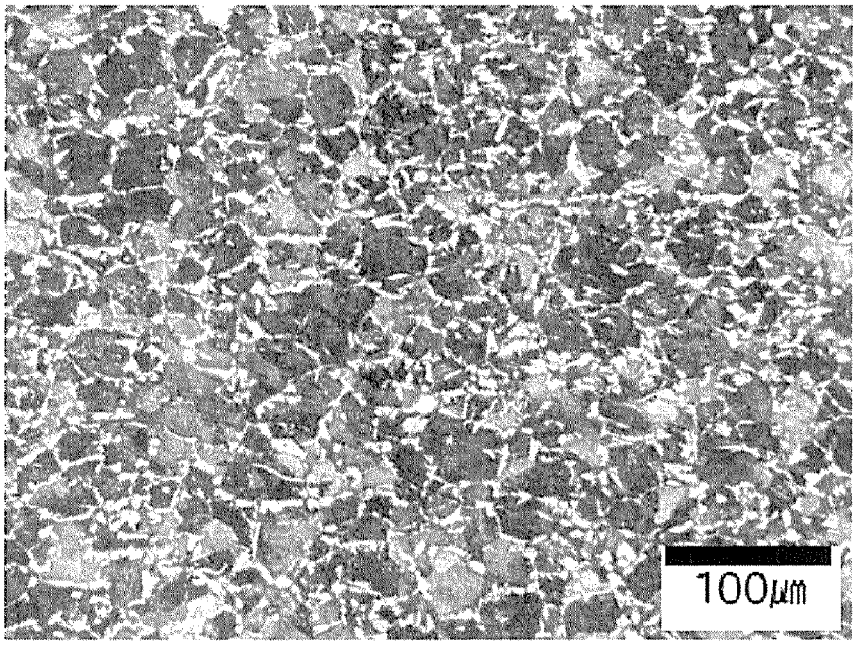
Figure 4:
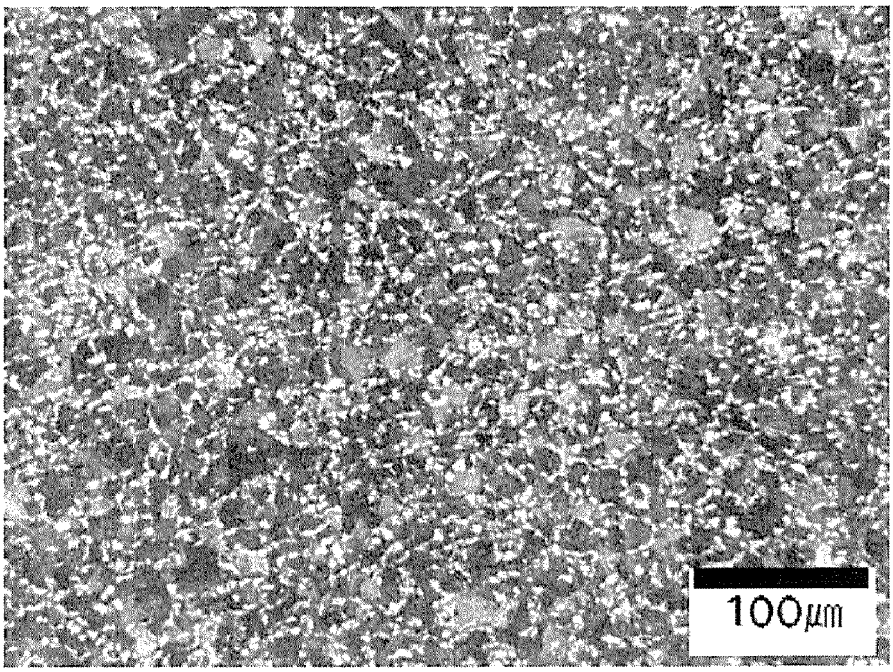
Figure 5:
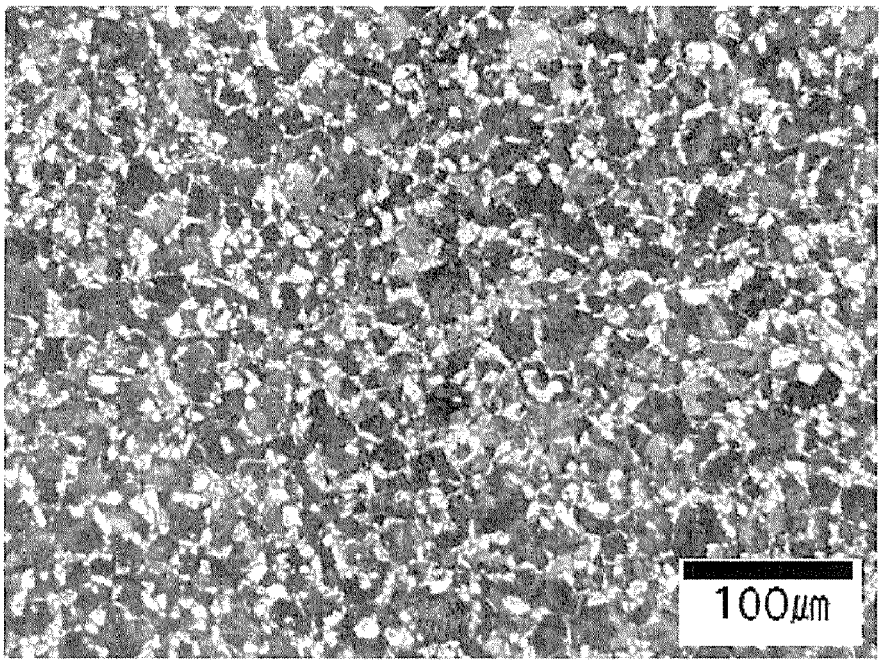

FIG. 2 is a photograph showing the structure of a specimen (specimen No. 1) having the D22 standard under the condition of the Comparative Example, and FIG. 3 shows a photograph showing the structure of a specimen (specimen No. 3) having the D22 standard under the condition of Example 1. Furthermore, FIG. 4 is a photograph showing the structure of a specimen (specimen No. 7) having the D22 standard under the condition of Example 3, and FIG. 5 is a photograph showing the structure of a specimen (specimen No. 10) having the D57 standard under the condition of Example 5.

Referring to FIGS. 2 to 5, a mixed phase of equiaxed ferrite and pearlite was observed in the specimens under the conditions of the Comparative Example and Examples 1 to 3. However, as shown in Table 4 above, the results of observing the grain size indicated that the grain sizes of the structures of specimen Nos. 3, 7 and 10 corresponding to the conditions of Examples 1 to 3 were smaller than the grain size of the structure of specimen No. 1 corresponding to the condition of the Comparative Example. In particular, when comparing specimens 1, 3 and 7, it can be seen that as the grain sizes of structure phases in the steel bars having the same diameter (22 mm) become smaller, the yield strengths increase and the yield ratios decrease. Therefore, it is considered that refinement of grains of the microstructures derived the high-strength and high seismic resistance characteristics of the steel bars according to the Examples of the present invention.

As described above, according to the embodiment of the present invention, the central portion of the high-strength steel bar may have a composite structure including equiaxed ferrite and pearlite, and the surface portion of the high-strength steel bar may have a tempered martensite structure.

Specifically, in the cross-section obtained by cutting the high-strength steel bar in a direction perpendicular to the lengthwise direction of the high-strength steel bar, the high-strength steel bar may include ferrite having an area fraction of 24 to 30%, pearlite having an area fraction of 48 to 59%, and tempered martensite having an area fraction of 17 to 22%. The tempered martensite may constitute the hardened layer of the high-strength steel bar. Namely, the hardened layer of the high-strength steel bar may have an area fraction of about 17 to 22%.

In one specific example, the grain size of the ferrite may be 8 to 20 μm, and the grain size of the pearlite may be 25 to 48 μm. The central portion of the high-strength steel bar may have a hardness of about 244 Hv, and the hardened layer of the high-strength steel bar may have a hardness of 326 Hv.

Meanwhile, the high-strength steel bar manufactured according to one embodiment of the present invention may have a yield strength (YS) and a tensile strength (TS), which are determined by multiple parameters as described below. The parameters may be determined by the alloy composition of the steel bar according to the embodiment of the present invention, process conditions, the area fractions of phases in the steel bar, the diameter of the steel bar, etc.

$$\text{Yield strength (YS)}=57+1800\cdot[C]+350\cdot[Mn]+19\cdot[HLVF]+8\cdot[FVF]-[FDT]-[Dia]$$

$$\text{Tensile strength (TS)}=1764-19093\cdot[C]-81\cdot[Mn]+1020\cdot[V]+30.9\cdot[HLVF]+0.424\cdot[PCS]+4.81\cdot[FDT]+58.3\cdot[WAP]$$

In the above equations, the yield strength and the tensile strength are in units of MPa, and [C], [Mn] and [V] denote the contents of carbon, manganese and vanadium, respectively, and are in units of wt %. [HLVF] denotes the area fraction (%) of a hardened surface layer in the cross-section obtained by cutting the high-strength steel bar in the direction perpendicular to the lengthwise direction of the high-strength steel bar. Specifically, the hardened surface layer refers to the area fraction (%) of the surface portion composed of tempered martensite. [FVF] denotes the area fraction (%) of ferrite in the cross-section of the high-strength steel bar. [PCS] denotes the grain size (μm) of pearlite in the cross-section of the high-strength steel bar. [Dia] denotes the diameter (mm) of the steel bar.

[FDT] denotes the finish rolling temperature (° C.) of the hot-rolling step of the method for manufacturing the high-strength steel bar, and [WAP] denotes in the flow rate ($m^3$/hr) of cooling water in the tempcore process.

In addition, 57, 1800, 350, 19, 8, −1, and −1, which are the coefficients of the equation for calculating the yield strength (YS), are in units of MPa, MPa/wt %, MPa/wt %, MPa/area fraction %, MPa/area fraction %, MPa/° C., and MPa/mm, respectively.

Meanwhile, 1764, −19093, −81, 1020, 30.9, 0.424, 4.81, and 58.3, which are the coefficients of the equation for calculating the tensile strength (TS), are in units of MPa, MPa/wt %, MPa/wt %, MPa/wt %, MPa/area fraction %, MPa/μm, MPa/° C., and MPa/bar, respectively.

Although the present invention has been described above in conjunction with the embodiments, those skilled in the art will appreciate that various modifications or variations are possible. These modifications and variations can be considered to fall within the scope of the present invention, as long as they do not depart from the scope of the present invention. Therefore, the scope of the present invention should be determined by the appended claims.

The invention claimed is:

1. A high-strength steel bar comprising, by weight %: 0.18% to 0.45% carbon (C); 0.05% to 0.30% silicon (Si); 0.40% to 3.00% manganese (Mn); greater than 0% and not more than 0.04% phosphorus (P); greater than 0% and not more than 0.04% sulfur (S); greater than 0% and not more than 1.0% chromium (Cr); greater than 0% and not more than 0.50% copper (Cu); greater than 0% and not more than 0.25% nickel (Ni); 0.10% to 0.50% molybdenum (Mo); greater than 0% and not more than 0.040% aluminum (Al); greater than 0% and not more than 0.20% vanadium (V); greater than 0% and not more than 0.040% nitrogen (N); 0.1% antimony (Sb); 0.011% to 0.1% tin (Sn); and the balance of iron (Fe) and other inevitable impurities, wherein a central portion of the high-strength steel bar has a composite structure comprising equiaxed ferrite and pearlite, and a surface portion of the high-strength steel bar has a tempered martensite structure.

2. The high-strength steel bar of claim 1, further comprising at least one of, by weight %, greater than 0% and not more than 0.50 wt % tungsten (W) and greater than 0% and not more than 0.005% calcium (Ca).

3. The high-strength steel bar of claim 1, having a yield strength of at least 500 MPa and a yield ratio of 0.8 or lower.

4. A high-strength steel bar comprising, by weight %: 0.18% to 0.45% carbon (C); 0.05% to 0.30% silicon (Si); 0.40% to 3.00% manganese (Mn); greater than 0% and not more than 0.04% phosphorus (P); greater than 0% and not more than 0.04% sulfur (S); greater than 0% and not more than 1.0% chromium (Cr); greater than 0% and not more than 0.50% copper (Cu); greater than 0% and not more than 0.25% nickel (Ni); 0.10% to 0.50% molybdenum (Mo); greater than 0% and not more than 0.040% aluminum (Al); greater than 0% and not more than 0.20% vanadium (V); greater than 0% and not more than 0.040% nitrogen (N); 0.05% to 0.06% antimony (Sb); 0.011% to 0.1% tin (Sn); and the balance of iron (Fe) and other inevitable impurities, wherein a central portion of the high-strength steel bar has a composite structure comprising equiaxed ferrite and pearlite, and a surface portion of the high-strength steel bar has a tempered martensite structure.

* * * * *